United States Patent [19]

Conlow

[11] Patent Number: 4,778,342

[45] Date of Patent: Oct. 18, 1988

[54] TURBINE BLADE RETAINER

[75] Inventor: Frank J. Conlow, Allentown, N.J.

[73] Assignee: Imo Delaval, Inc., Princeton, N.J.

[21] Appl. No.: 920,168

[22] Filed: Oct. 17, 1986

Related U.S. Application Data

[63] Continuation-in-part of Ser. No. 758,487, Jul. 24, 1985, abandoned.

[51] Int. Cl.[4] ..... F01D 5/32

[52] U.S. Cl. ..... 416/220 R; 416/193 A; 416/213 R

[58] Field of Search ..... 416/193 A, 212 A, 212 R, 416/213 R, 219 R, 219 A, 220 R, 220 A, 221, 217, 214 A

[56] References Cited

U.S. PATENT DOCUMENTS

| | | | |
|---|---|---|---|
| 363,074 | 5/1887 | Lockwood | 416/220 R X |
| 1,347,031 | 7/1920 | Guy | 416/220 R |
| 1,619,133 | 3/1927 | Kasley | 416/220 R |
| 2,753,149 | 7/1956 | Kurti | 416/220 R |
| 2,999,668 | 9/1961 | Howald et al. | 416/217 X |
| 3,249,293 | 5/1966 | Koff | 416/220 R X |
| 3,395,891 | 8/1968 | Burge et al. | 416/220 R |
| 3,666,376 | 5/1972 | Damlis | 416/219 |
| 3,720,481 | 3/1973 | Motta | 416/220 R |
| 3,936,222 | 2/1976 | Asplund et al. | 416/220 R X |
| 4,037,990 | 7/1977 | Harris | 416/220 R |
| 4,361,416 | 11/1982 | Rossmann | 416/214 A X |
| 4,453,891 | 6/1984 | Forestier | 416/220 R |
| 4,505,640 | 3/1985 | Hsing et al. | 416/219 R X |

FOREIGN PATENT DOCUMENTS

| | | | |
|---|---|---|---|
| 954466 | 12/1956 | Fed. Rep. of Germany | 416/220 R |
| 1031551 | 6/1953 | France | 416/214 A |
| 2524933 | 10/1983 | France | 416/220 R |
| 612057 | 6/1978 | U.S.S.R. | 416/217 |
| 27814 | 12/1913 | United Kingdom | 416/220 X |
| 731456 | 6/1955 | United Kingdom | 416/220 R |

*Primary Examiner*—Everette A. Powell, Jr.

*Attorney, Agent, or Firm*—Hopgood, Calimafde, Kalil, Blaustein & Judlowe

[57] ABSTRACT

Two-part turbine-blade retainer structures are disclosed for axial retention of each of a plurality of turbine blades to a rotor wheel, wherein radial retention is via fir-tree engagement of individual blade roots to the wheel. In a preferred embodiment, a male or bolt element of the retainer has a shank which is characterized by a smoothly cylindrical portion adjacent at one end to one of the heads; this cylindrical portion terminates at a shoulder, beyond which the shank is reduced and externally threaded. A sleeve or nut element of the retainer has an elongate threaded bore and is characterized by an outer cylindrical surface which extends to the second head. The two elements are proportioned to be inserted through opposite ends of a passageway and to be screwed together into firm engagement at the shoulder (i.e., at a location intermediate the two heads), with the sleeve covering the threads of the male element and the heads preventing the turbine blade from axial motion with respect to the wheel. A single weldment at one end secures final assembly.

7 Claims, 2 Drawing Sheets

TURBINE BLADE RETAINER

RELATED CASE

This application is a continuation-in-part of copending application, Ser. No. 758,487, filed July 24, 1985, now abandoned.

BACKGROUND OF THE INVENTION

The present invention relates to retainers for preventing axial movement of turbine blades with respect to a turbine wheel and more specifically, to retainers that must be individually installed after all of the blades about the circumference of a turbine wheel are in place.

In turbo machinery, the turbine blades or buckets are typically attached to a turbine wheel or rotor by way of interlocking parts, commonly known as a fir-tree connection. The turbine blade carries at its base a male or root portion of the connection, while the wheel has at its circumference corresponding female or slot portions. A particular blade is engaged to the wheel by sliding the male portion of the fir tree of the blade into a female portion of the fir tree defined by the turbine wheel. Shoulders of the fir tree then radially secure the blade. Of course, the blades must also be axially secured.

Perhaps the most common method of axially securing the blades of a turbine involves the insertion of locking keys or pins into matching holes in the rotor and turbine blade. In typical systems each blade is configured with a platform which covers the securing pin of the adjacent turbine blade, and the last blade attached to the wheel is secured to the wheel differently from the other blades, typically by peening. Generally, in accordance with the above discussion, the blades must be attached to the wheel one-by-one in a predetermined sequence, and removed in the same manner. It is not always possible to sequentially attach the blades because of the blade geometry. For example, in turbines with vibration-damping integral interlocking shrouds, the blades of a particular turbine wheel are all connected via the shroud and assembled into a loading jig or fixture before they are loaded into the turbine wheel. It is therefore not possible to place the blades on the wheel one-by-one in a predetermined sequence since all of the blades must be placed on the wheel at the same time.

Various methods are known for axially securing turbine blades for use after all of the blades are in place on the wheel.

One method involves inserting a stainless-steel tube through a hole in the wheel, located at the junction of the blade and wheel. The hole is chamfered at both ends and after insertion, the tube is flared. Although acceptable for the service intended, the flared tube arrangement has several drawbacks. Assembly must be carried out by highly skilled craftsmen, particularly because of the chamfering and flaring operations. Excessive flaring can easily split the tube and/or the flaring operation can cause localized extrusion of tube material into the gap area between the blade and the wheel. This latter condition can cause stress concentrations leading to turbine failure.

Other known methods of axially securing turbine blades include soft metal rivets, as taught by Kurti in U.S. Pat. No. 2,753,149; bolts, as disclosed by Harris in U.S. Pat. No. 4,037,990 and by Asplund, et al. in U.S. Pat. No. 3,936,222; by way of interlocking side plates, as shown by Auriemma in U.S. Pat. No. 4,279,572; and by using a three piece blade-lock as described by Burge, et al. in U.S. Pat. No. 3,395,891.

Despite extensive efforts to develop individually installable turbine blade retainers, all such arrangements heretofore known have fallen short of achieving the desired characteristics in terms of reliability, rigidity, strength, and ease of installation.

It is accordingly an object of the invention to provide an individually installable turbine blade retainer which eliminates the need for precision installation techniques.

It is another object of the invention to provide a stronger, more rigid and secure turbine blade retainer for preventing axial motion of turbine blades in turbo machinery.

It is a further object of the invention to provide means for axially securing a turbine blade by a consistent and predictable procedure so that repairs and replacement of blades can be made by unskilled workers in a more reliable manner than heretofore known.

Still further objects and advantages of the inventive turbine blade retainer not specifically set forth here will become readily apparent upon consideration of the following description, drawings, and claims.

SUMMARY OF THE INVENTION

The present invention alleviates the shortcomings of the prior art. In the preferred form, this is accomplished by a turbine blade retainer comprised of two separable elements of substantially consistent cross sectional area over their length with enlarged heads positioned at each end.

A male or bolt element of the retainer has a shank which is characterized by a smoothly cylindrical portion adjacent at one end to one of the heads; this cylindrical portion terminates at a shoulder, beyond which the shank is reduced and externally threaded. A sleeve or nut element of the retainer has an elongate threaded bore and is characterized by an outer cylindrical surface which extends to the second head. The two elements are proportioned to be inserted through opposite ends of a passageway and to be screwed together into firm engagement at the shoulder (i.e., at a location intermediate the two heads), with the sleeve covering the threads of the male element and the heads preventing the turbine blade from axial motion with respect to the wheel. The male element is so dimensioned that its externally threaded part projects through the head of the sleeve element, and the latter has a short counterbore to permit external welded access, to prevent loosening during turbine operation.

BRIEF DESCRIPTION OF THE DRAWINGS

The invention is described in detail below with reference to the drawings, in which.

DETAILED DESCRIPTION

Figure 1:
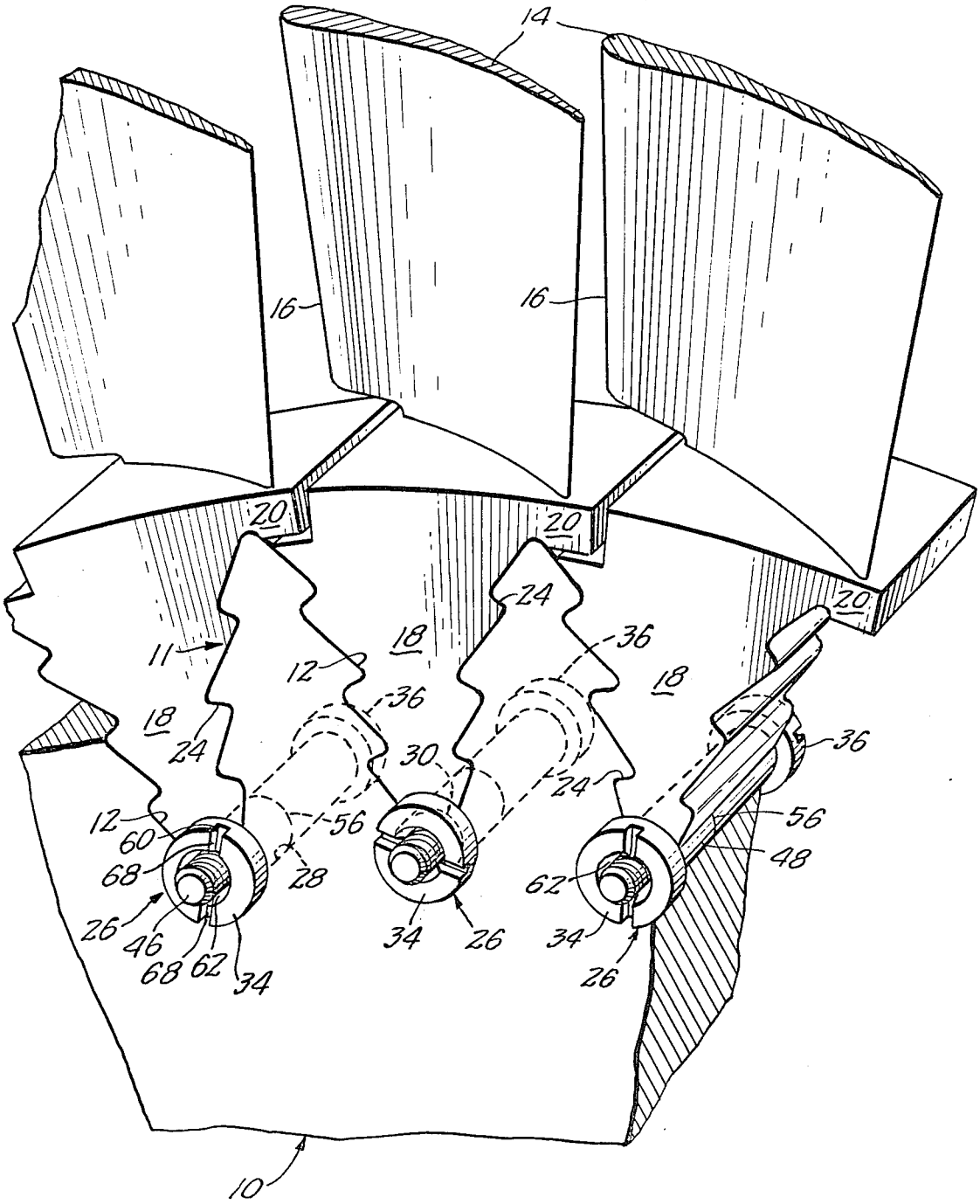
FIG. 1 is a fragmentary perspective view showing the inventive turbine blade retainer securing a plurality of turbine blades to a wheel of a turbine.

Referring now to the drawings, FIG. 1 shows generally the construction of a turbine rotor assembly wherein plural turbine blade retainers axially secure blades 14 to a wheel 10. The rotor wheel 10 is characterized by like radially outward fir-tree formations 11 at angularly spaced locations about the wheel axis, defining axially extending slots 12 between adjacent profiles of adjacent fir-tree formations. Each turbine blade has a radially outer airfoil portion 16 and a radially inner root portion 18. Each root portion 18 is configured to form the male part of a fir-tree connection, that is, for radial retention in one of the slots 12, by reason of root profiling in axially engageable conformance with adjacent profiles of slot 12, the axial extent of the blade root 18 being equal to the axial width of the fir-tree formation 11. Intermediate root 18 and airfoil portion 16 is a platform 20. In prior-art systems, platform 20 often covered the retaining key or pin of the adjacent turbine blade.

A method for retaining the turbine blades is required because, although the connection between fir-tree profiles or root/slot engagement secures blades against radial displacement by virtue of axially extending profile shoulders 24, it does not axially secure the blades.

According to the invention, each of the blades is axially secured by a turbine blade retainer 26, each retainer 26 being disposed in an axial passageway 28. Each passageway 28 is defined by a semicylindrical groove 30 at the radially inner limit of a root 18 and by a semicylindrical groove 32 at the radiallly inner limit of each slot 12 of wheel 10. Each passageway 28 is thus contiguous with both a blade root 18 and the turbine wheel; preferably, and as shown, the opposed cylindrical arcs of grooves 30, 32 are of substantially the same geometric cylinder, having an axis parallel to the wheel axis.

Retainer 26 has at its ends a pair of heads, 34 and 36 respectively, each of which engages surfaces of both the turbine wheel and the blade in order to axially secure the blade.

Figure 2:
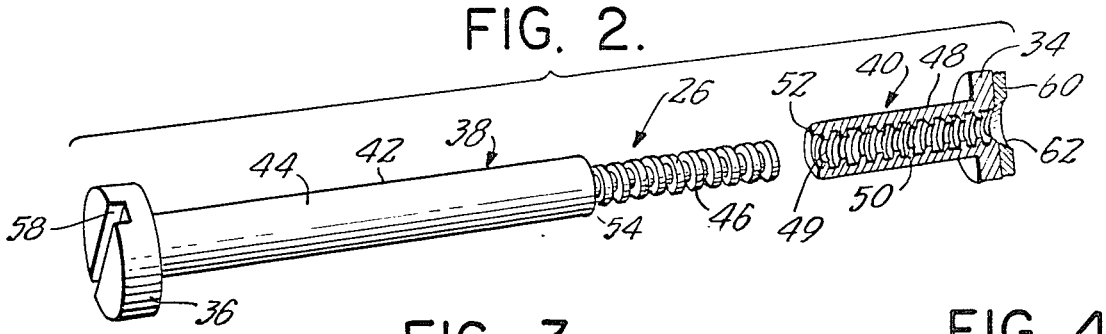
FIG. 2 is an exploded perspective view showing the parts of the blade retainer of FIG. 1, with one of the parts shown in longitudinal section.
Figure 3:
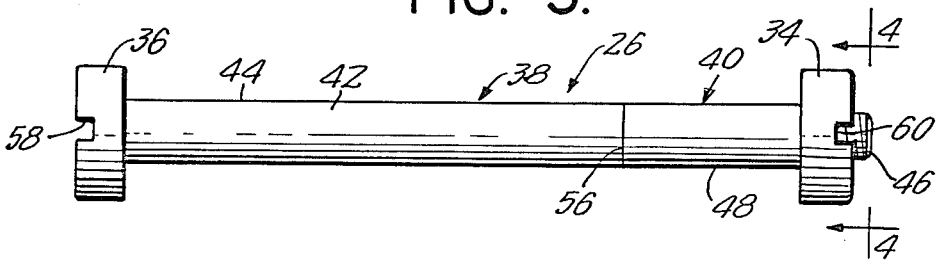
FIG. 3 is a side view of the retainer alone, with its parts assembled to each other.
Figure 4:
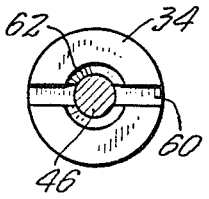
FIG. 4 is an end view as seen from the aspect 4-4 of FIG. 3.

The construction of retainer 26 is more specifically illustrated in FIGS. 2 through 4. Retainer 26 is preferably made of a suitable stainless steel for strength and durability and includes a male or bolt element 38 and a separable sleeve or nut element 40. The male element 38 is characterized by a shank 42 with a smooth cylindrical portion 44 proximate to the head 36, portion 44 being of substantially constant diameter over its length. Beyond portion 44, shank 42 reduces, at a shoulder 54, and is externally threaded along an end portion 46.

Sleeve element 40 is characterized by a smooth cylindrical outer surface 48, one end of which terminates at head 34 and by a bore 49 having threads 50 for engagement with threads of the end 46 of male element 38. Cylindrical surfaces at 44, 48 are to the same diameter, and when the end 52 of element 40 is threadedly advanced into limiting abutment with shoulder 54, the elements 38, 40 become interlocked and mutually stabilized, producing a nearly imperceptable seam 56 at juncture of the cylindrical surfaces 44, 48. This firm stabilized engagement of the male and sleeve elements produces a rigid retainer having high shear strength.

Both heads of retainer 26 are preferably provided with means such as diametrically extending slots 58, 60, for tightening the respective parts together. Sleeve bore 49 has a flared or tapered counterbore 62 intersecting slot 60, for a purpose discussed below.

Each of the elements 38, 40 is preferably formed of a single piece of stainless steel and is dimensioned such that threaded portion 36 of the male element emerges and projects through sleeve 40 upon firm engagement of the elements.

Figure 5:
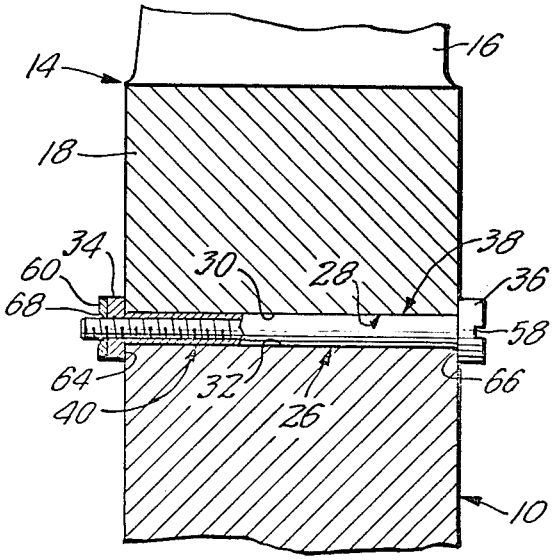
FIG. 5 is an enlarged fragmentary sectional view taken in the plane defined by the rotor axis and by one of the blade retainers of FIG. 1.

In use, and referring to FIG. 5, elements 38, 40 of each retainer 26 are inserted into opposite ends of a passageway 28 and are screwed together into firm engagement, with retaining shoulder 64, 66 of the respective heads 34 and 36 lapping axial-end faces of both a root 18 and wheel 10, as shown. The sleeve covers the threads of the externally threaded portion of the male element to define a smooth surface of substantially constant diameter. All parts of assembly 10 are machined to very close tolerances. Retainer 26 snugs against itself, yet is precisely constructed to engage the surfaces of the wheel and the root of a turbine blade to axially secure the blade, thus insuring that operating load remains uniformly distributed along the shoulders of each fir-tree connection.

When in place, the part of shank 44 projecting through sleeve 40 is spot-welded thereto by a tungsten inert-gas (TIG) or other suitable welding technique in order to lock the elements together. A bead of weld metal 68 in the counterbore 62 at bisecting slot 60 prevents relative motion of the elements.

Figure 6:
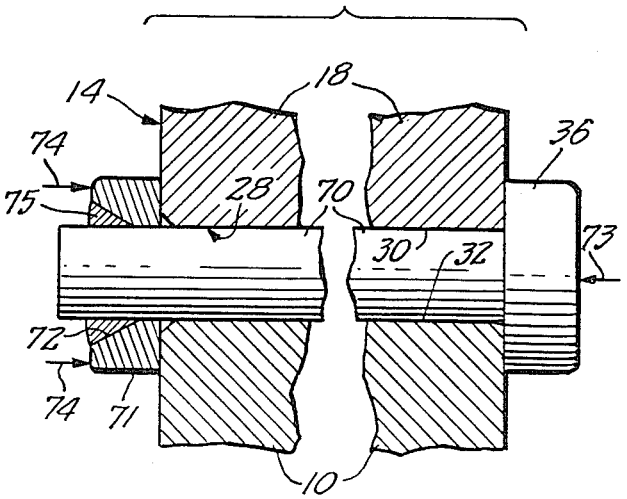
FIG. 6 is a view similar to FIG. 5, to show another embodiment.

In the embodiment of FIG. 6, the male member 70 is a stainless steel cylindrical pin which conforms uniformly to the full length of passageway 28. Member 70 has an integrally formed had 36' at one end, and its other end projects sufficiently beyond passageway 28 to extend through the female member 71. The female member 71 is a stainless steel collar having a smooth bore which fits pin 70 and which is expanded by a short counterbore 72 at its outer end. Opposing arrows 73, 74 applied to the male and female elements 70, 71 will be understood to suggest temporary application of axial-clamping force while weld metal 75 is applied between counterbore 72 and that end portion of pin 70 which is lapped within the counterbore. Welding conditions are as described above.

The inventive retainer will be seen to achieve the objects of the invention in providing a superior, individually installable turbine blade retainer which is preformed and eliminates the need for precision installation techniques.

In addition, the inventive turbine blade retainer has more strength than previously known retainers. Indeed, it has been found that turbine-blade retainers of the invention exhibit shear strength up to ten times that of the flared-tube retainer discussed above.

Although the invention has been discussed in detail in connection with illustrative embodiments, various modifications may be made without departing from the claimed scope of the invention.

What is claimed is:

1. In a turbine rotor, the combination comprising a wheel having an angularly spaced plurality of radially outwardly directed fir-tree formations about the wheel axis and defining axially extending slots between adjacent profiles of adjacent fir-tree formations, a corresponding plurality of blades each of which has a root configured for radial retention in one of said slots by reason of root profiling in axially engageable conformance with adjacent profiles of the adjacent fir-tree formations of said one slot, the axial extent of said blade root being equal to the axial width of said fir-tree formations, radially inner confronting limits of said blade root and of the root-engaged slot between fir-tree formations defining a through-passage and being characterized by opposed cylindrical arcs of substantially the same geometric cylinder having an axis parallel to the wheel axis, and an elongate two-part axially extending retainer having a cylindrical outer surface nested between said opposed cylindrical arcs; one of said retainer parts having (a) a headed end, (b) a contiguous cylindrical shank defining one fraction of said cylindrical outer surface and of axial extent less than the axial extent of said root and wheel formations, and (c) a reduced and threaded opposite end; the other of said retainer parts being a continuous cylindrical sleeve defining the remaining fraction of said cylindrical outer surface, said sleeve having a headed end and a threaded bore engaged to the threaded end of said one retainer part; said headed ends being of sufficient radially outward extent to lap both said root and wheel formations when in threadedly engaged relation.

2. In a turbine rotor, the combination comprising a wheel having an ahgularly spaced plurality of radially outwardly directed fir-tree formations about the wheel axis and defining axially extending slots between adjacent profiles of adjacent fir-tree formations, a corresponding plurality of blades each of which has a root configured for radial retention in one of said slots by reason of root profiling in axially engageable conformance with adjacent profiles of the adjacent fir-tree formations of said one slot, the axial extent of said blade root being equal to the axial width of said fir-tree formations, radially inner confronting limits of said blade root and of the root-engaged slot between fir-tree formations being spaced to define a through-passage on an alignment parallel to the wheel axis, and an elongate two-part axially extending retainer having a cylindrical outer surface on said alignment and nested between said confronting limits; one of said retainer parts having (a) a headed end, (b) a contiguous cylindrical shank defining one fraction of said cylindrical outer surface and of axial extent less than the axial extent of said root and wheel formations, and (c) a reduced and threaded opposite end; the other of said retainer parts being a continuous cylindrical sleeve defining the remaining fraction of said cylindrical outer surface, said sleeve having a headed end and a threaded bore engaged to the threaded end of said one retainer part; said headed ends being of sufficient radially outward extent to lap both said root and wheel formations when in threadedly engaged relation.

3. In a turbine rotor, the combination comprising a wheel having an angularly spaced plurality of radially outwardly directed formations about the wheel axis, said formations being characterized by blade-retaining profiles and defining axially extending slots between adjacent profiles of adjacent formations, a corresponding plurality of blades each of which has a root configured for radial retention in one of said slots by reason of root profiling in axially engageable conformance with adjacent blade-retaining profiles of the adjacent formations of said one slot, the axial extent of said blade root being equal to the axial width of said formations, radially inner confronting limits of said blade root and of the root-engaged slot between adjacent formations being spaced to define a through-passage on an alignment parallel to the wheel axis, and an elongate two-part axially extending retainer having a cylindrical outer surface on said alignment and nested between confronting limits; one of said retainer parts having (a) a headed end, (b) a contiguous cylindrical shank defining one fraction of said cylindrical outer surface and of axial extent less than the axial extent of said root and wheel formations, and (c) a reduced and threaded opposite end; the other of said retainer parts being a continuous cylindrical sleeve defining the remaining fraction of said cylindrical outer surface, said sleeve having a headed end and a threaded bore engaged to the threaded end of said one retainer part; said headed ends being of sufficient radially outward extent to lap both said root and wheel formations when in threadedly engaged relation.

4. The combination of any one of claims 1, 2 or 3, in which said retainer parts are in tight threaded engagement and cooperatively present a smooth cylindrical surface within said through-passage.

5. The combination of any one of claims 1, 2 or 3, in which said threaded end projects beyond the headed end of said other retainer part when said retainer parts are in tight threaded engagement, and a weldment of said projecting threaded end to the headed end of said retainer part.

6. The combination of any one of claims 1, 2 or 3, in which the headed end of said other retainer part is characterized by an outwardly facing transverse slot, said threaded end projecting into said slot when said retainer parts are in tight threaded engagement, and a weldment of said projecting threaded end at said slot.

7. The combination of any one of claims 1, 2 or 3, in which the headed end of said other retainer part is characterized by an outwardly flaring counterbore, said threaded end projecting into said counterbore when said retainer parts are in tight threaded engagement, and a weldment of said projecting head end at said counterbore.

* * * * *